United States Patent [19]

Kajiyama et al.

[11] 3,994,392

[45] Nov. 30, 1976

[54] CONTAINER FOR A SOLUTION CONTAINING HETEROPOLYACID IONS

[75] Inventors: Yoshihisa Kajiyama; Takao Tomita, both of Tokuyama; Eiichi Wataki, Shinnanyo, all of Japan

[73] Assignee: Tokuyama Soda Kabushiki Kaisha, Japan

[22] Filed: Sept. 11, 1975

[21] Appl. No.: 612,447

[30] Foreign Application Priority Data

Sept. 17, 1974 Japan ..... 49-105982

[52] U.S. Cl. ..... 206/524.3; 21/2.5 R; 23/252 A; 148/6.14 R; 148/6.15 R; 148/31.5; 75/128 R; 427/239; 428/35

[51] Int. Cl.² ..... B65D 81/26; B65D 81/36; C23F 7/00

[58] Field of Search ..... 23/252 A, 285; 75/128 R; 252/437, 458, 465, 467; 427/239; 428/35; 206/84; 148/6.14 R, 6.15 R, 31.5; 21/2.7 R, 2.5 R

[56] References Cited

UNITED STATES PATENTS

| | | | |
|---|---|---|---|
| 1,339,378 | 5/1920 | Strauss | 23/252 A |
| 2,501,349 | 3/1950 | Nagel et al. | 148/6.15 R |
| 2,870,171 | 1/1959 | Gable | 252/467 X |
| 2,964,434 | 12/1960 | Coleman | 148/6.15 R X |
| 3,078,992 | 2/1963 | Shapiro et al. | 206/84 |
| 3,511,890 | 5/1970 | Reusser | 252/467 X |

OTHER PUBLICATIONS

Perry, "Chemical Engineers" Handbook, 4th ed. pp. 23–37 (1963).

Nelson, "Shell Development Co. Corrosion Data Survey" (1954) p. S–1.

*Primary Examiner*—Norman Yudkoff
*Assistant Examiner*—Barry I. Hollander
*Attorney, Agent, or Firm*—Sherman & Shalloway

[57] ABSTRACT

A container for a solution containing heteropolyacid ions, at least that surface of the container which makes contact with the solution containing heteropolyacid ions selected from the group consisting of silicotungstic acid, borotungstic acid, phosphotungstic acid, silicomolybdic acid and phosphomolybdic acid and being made of an alloy comprising 2 to 7% by weight of nickel, 19 to 27% by weight of chromium, not more than 0.5% by weight of carbon and the remainder being iron and minor elements.

14 Claims, 4 Drawing Figures

CONTAINER FOR A SOLUTION CONTAINING HETEROPOLYACID IONS

This invention relates to a container for a solution containing heteropolyacid ions, and more specifically, to a container for a solution containing a heteropolyacid ion which is made of a specific stainless steel at least at that part which will come into contact with the solution.

Heteropolyacids and salts thereof are widely used as surface treating agents for metals, chelating agents or lake-forming agents for dyes, and catalysts in various organic syntheses. Since chemicals having acidity, such as heteropolyacids, are likely to cause corrosion of metals, they will naturally have to be contained in acid-resistant receptacles, but neutral salts are believed to require no consideration of special receptacles. It is known on the other hand that a solution containing a heteropolyacid ion is decomposed by the catalytic action of an iron ion. Hence, it has been considered as impossible to use iron or an iron alloy to make that surface of a container which will come into contact with a solution containing heteropolyacid ions. Since the decomposition of heteropolyacid by iron is accelerated at higher temperatures and pressures, reactors to be used at high temperatures and pressures, for example, in the production of alcohols or carboxylic acid esters by the hydration of olefins using heteropolyacid ions as a catalyst as disclosed in British Patent 1,377,254 and U.S. Pat. No. 3,644,497 are lined with noble metals such as gold, platinum, or silver, or made of expensive materials such as nickel, chromium, zirconium, tantalum or titanium. The use of such an expensive material is not economically desirable, and moreover, by a special action of the heteropolyacid ions, the metal constituting the container undergoes hydrogen embrittlement. Although such hydrogen embrittlement takes place even at relatively low temperatures, it is extremely remarkable at a temperature of more than 200° C. and at high pressures. Accordingly, no industrially suitable materials have been found to make receptacles for heteropolyacid ions.

It is an object of this invention to provide a container for heteropolyacid ions which is made of a material that is relatively cheap, possesses corrosion resistance, and does not undergo hydrogen embrittlement nor promote the decomposition of the heteropolyacid ions.

It is another object of this invention to provide a reaction vessel which is suitable for the production of alcohols by the hydration of olefins using heteropolyacid ions as a catalyst.

Other objects of this invention will become apparent from the following detailed description.

According to this invention, there is provided a container for a solution containing heteropolyacid ions at least that surface of the container which makes contact with the solution containing heteropolyacid ions being made of an alloy comprising 2 to 7% by weight of nickel, 19 to 27% by weight of chromium, not more than 0.05% by weight of carbon and the remainder being iron and unavoidable or improving components.

The "container," as used in this invention, denotes containers for handling heteropolyacid ions, such as receptacles for transporting or storing a solution containing heteropolyacid ions, a receptacle for producing heteropolyacid or salts thereof, or a reaction vessel for performing a reaction in which heteropolyacid ions participate. It is especially suitable as a container for including a solution containing heteropolyacid ions at a high temperature of, say, at least 100° C. and/or at a high pressure of, say, at least 10 Kg/cm$^2$.

As usually recognized by chemists, the heteropolyacid in the present invention is a polyacid which is formed by condensation of an inorganic acid and which is composed of at least two kinds of metal. Generally, it takes a form in which one kind of metal is present as a central atom, and a polyacid group of another kind of metal is coordinated with the central atom. Specific examples of the heteropolyacids are silicotungstic acid, for example, $H_4(SiW_{12}O_{40})$; borotungstic acid, for example, $H_5(BW_{12}O_{40})$; phosphotungstic acid, for example, $H_3(PW_{12}O_{40})$ and $H_6(P_2W_{18}O_{62})$; silicomolybdic acid, for example, $H_4(SiMo_{12}O_{40})$; and phosphomolybdic acid, for example, $H_3(PMo_{12}O_{40})$. Usually, the polyacid metal is V, Mo or W, and examples of the central atom are H, Cu, B, Al, C, Si, Ge, Sn, Ti, Zr, Ce, Th, N, P, As, Sb, V, Nb, Ta, Cr, Mo, W, U, S, Se, Te, Mn, I, Fe, Co, Ni, Rh, Os, Ir, and Pt. Of these, suitable heteropolyacid ions are those in which the polyacid is tungsten or molybdenum, and the central atom is silicon, phosphorus or boron, for example, $(SiW_{12}O_{40})^{-4}$, $(BW_{12}O_{40})^{-5}$, $(PW_{12}O_{40})^{-3}$, and $(SiMo_{12}O_{40})^{-4}$. In the form of a compound, acids, acidic salts and neutral salts of these can, for example, be mentioned.

Some of the alloys composed mainly of nickel, chromium and iron (to be referred to as a chromium/nickel stainless steel) which constitute the receptacles of this invention and stainless steels having a similar composition have already been described extensively in the literature. However, because these stainless steels contain much iron, it was quite impossible in the past to expect that such stainless steels would be suitable for producing containers for including solutions of heteropolyacid ions whose decomposition is accelerated by iron ions. It can be anticipated that these stainless steels would have feasible corrosion resistance. However, when a solution of a heteropolyacid is included in a container made of such specific stainless steel, the container is relatively liable to be corroded in the early stage, for example, up to 300 hours, and this apparently indicates the industrial infeasibility of these stainless steel materials. However, when it is used for more than a certain period of time, the corrosion stops completely, and the container exhibits superior properties for industrial use. It is not entirely clear by what action this phenomenon is caused. Our investigations however show that when silicomolybdic acid is used as the heteropolyacid, tough films of iron molybdate, chromium molybdate, and nickel molybdate are formed on the surface of the stainless steel that has been used for long periods of time, and when silicotungstic acid is used, tough films of iron tungstate, chromium tungstate, and nickel tungstate are formed. We therefore concluded that by the reaction of the heteropolyacid ions with the alloy components on the surface of the stainless steel material, a chemically stable protective film is formed on the surface of the material, and by the action of the protective film, the corrosion of the material is subsequently prevented and the decomposition of the heteropolyacid ions can be prevented. The formation of the protective film is very unusual as compared with general oxidized films, and the toughness of the film varies according to the relation between the chromium/nickel stainless steel and the heteropolyacid ions, especially the composition of the chromium/nickel stainless steel. Such an operation and result could not be expected.

Figure 1:
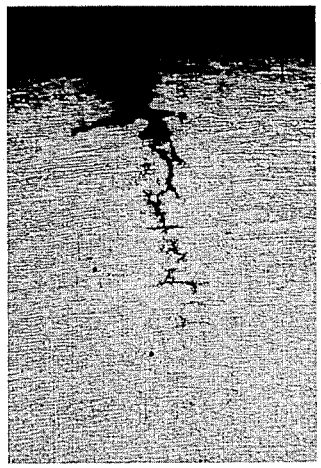
FIGS. 1 and 2 are microphotographs of metal structures having compositions outside the scope of the present invention which have been treated with solution containing heteropolyacid ions.

When the contents of Ni, Cr and C in the chromium/-nickel stainless steel used in this invention are outside the ranges specified in this invention (i.e., Ni 2 to 7%, Cr 19 to 27%, and C not more than 0.05%), the heteropolyacid ions are decomposed and the resulting stainless steel cannot be used as a material for the container of this invention. Stated in more detail, the heteropolyacid ions undergo decomposition when the Ni content is less than 2% or larger than 7%. Some of chromium steels containing no nickel have sufficient corrosion resistance as industrial materials, but are not feasible because intergranular cracking occurs as a result of undergoing sensitization. When the Cr content is less than 19%, the degree of decomposition of the heteropolyacid is high, and when it exceeds 27% by weight, the processing, such as welding, of the chromium/nickel stainless steel becomes difficult. In either case, the stainless steel cannot be used as an industrial material for the present invention. The carbon content most affects the result of the present invention. If the carbon content exceeds the limit (i.e., 0.05% by weight), corrosion occurs in the grain boundaries by the influence of heat in welding (which is called "intergranular corrosion"), for example, even when the Ni and Cr contents are within the above-specified ranges, and it is likely that cracks will occur at those parts which will be subjected to tensile stress. Accordingly, such stainless steels cannot be used to make the containers of this invention. Furthermore, the carbon content may be any extent below 0.05% by weight, but it is difficult by the steel-making technique to reduce the carbon content substantially to zero.

As stated hereinabove, the chromium/nickel stainless steel used in the present invention may comprise 2 to 7% of Ni, 19 to 27% of Cr, not more than 0.05% of carbon and the remainder being iron. Other elements incidental to the raw material, such as silica, manganese or phosphorus and elements to be added in order to improve the properties of the stainless steel, such as molybdenum, nitrogen or copper, scarcely affect the final product. Accordingly, these unavoidable and improving components (to be referred to as "minor components") may be present in the final product, and in some cases, are positively included as desired.

Our investigations show that the presence of less than 1% by weight of Si and P and less than 2% by weight of Mn as unavoidable components does not at all impair the properties of the resulting chromium/nickel stainless steel, and the inclusion of less than 3% of Mo and less than 1% each of Cu and N is also allowable. The molybdenum is desirable component for preventing pitting corrosion.

The chromium/nickel stainless steel of the specific composition in accordance with this invention possesses not only very superior corrosion resistance to heteropolyacid ions, but also a superior property of substantially preventing the decomposition of heteropolyacid ions.

Expensive materials generally used in the reaction system in which heteropolyacid ions are present, such as zirconium, tantalum or titanium, are satisfactory in regard to corrosion resistance, but are difficult to use unless a special treatment is given against hydrogen embrittlement. In contrast, the chromium/nickel stainless steel used in the present invention does not pose any problem of hydrogen embrittlement, and therefore, is advantageous for use in reaction apparatus including reactors for high temperatures and/or high pressures. When operating under severe conditions of more than 100° C. and more than 10 Kg/cm$^2$, the chromium/-nickel stainless steel in accordance with the present invention can be suitably used to make reactors for the hydration reaction of olefins disclosed in British Patent Specification No. 1,377,254 or German OLS No. 2,215,380.

Figure 4:
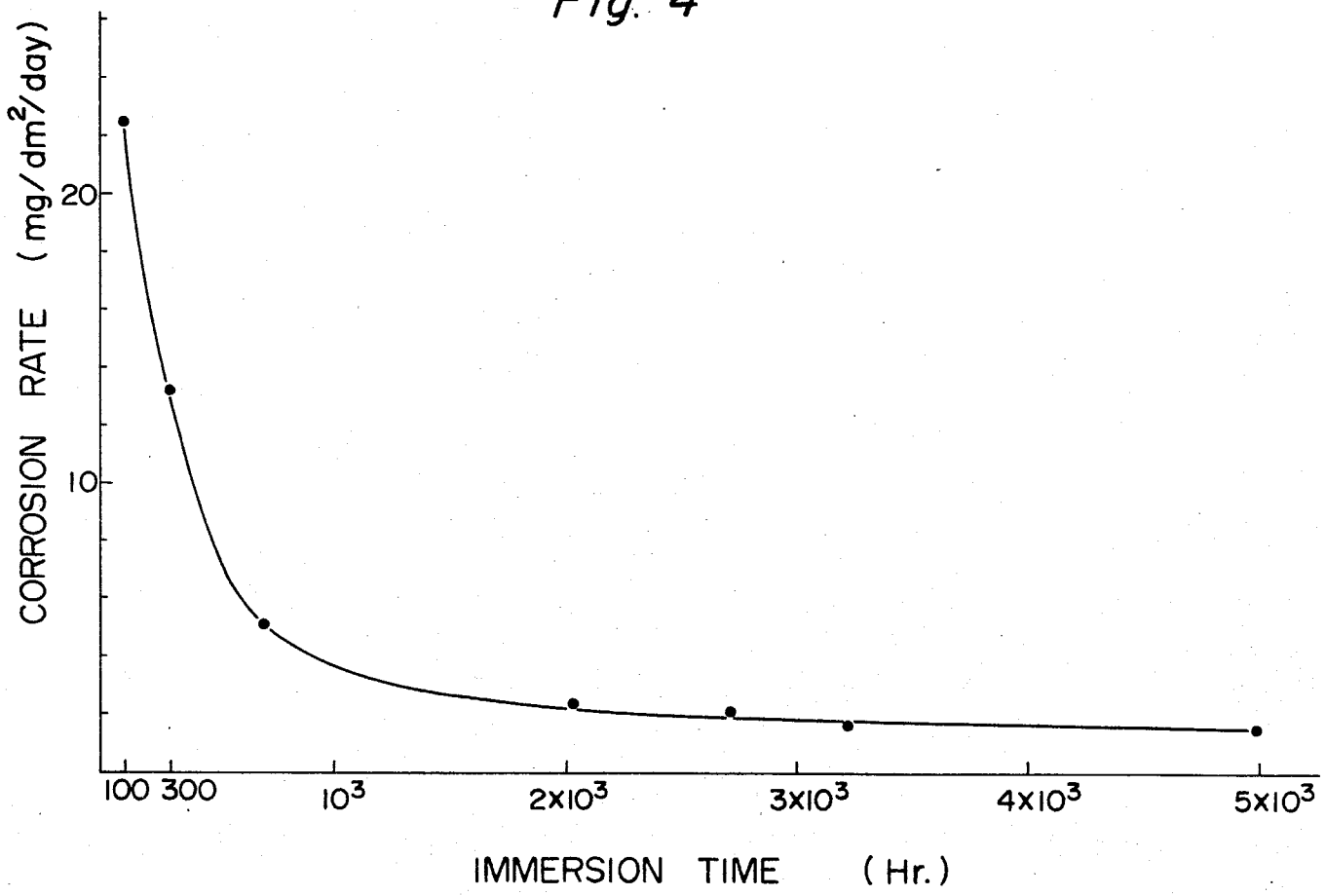
FIG. 4 is a plot of corrosion rate for a metal structure according to the present invention versus immersion time in a solution containing heteropolyacid ions.

As will be shown in Example 4, Table 6 and FIG. 4, when a container made of the chromium/nickel stainless steel is brought into contact with a solution containing heteropolyacid ions, the amount of the stainless steel corroded markedly decreases after a lapse of 300 hours, especially 500 hours, above all 700 hours. Since the corrosion occurs as a result of a reaction of the chromium/nickel stainless steel on the surface of the container with the heteropolyacid ions, the decrease in the amount of corrosion means the reduction of the decomposition of the heteropolyacid to be included in the container.

Accordingly, when it is desirable to inhibit the decomposition of heteropolyacid as much as possible and maintain the concentration of an iron ion in the reaction solution at as low a level as possible as in the case of preparing an alcohol or carboxylic acid ester by the hydration of an olefin, it is advantageous to make at least that surface of the reactor which makes contact with the reaction solution using the chromium/nickel stainless steel specified in the present invention, and use it for the hydration reaction of olefins after bringing that surface of the reactor into contact with a solution of heteropolyacid ions for at least 300 hours, preferably at least 500 hours. Thus, the hydration of olefins can be performed very satisfactorily using the cheap chromium/nickel stainless steel without the need to line the inside surface of the reactor with a noble metal such as gold, platinum or silver or an expensive material such as nickel, chromium, zirconium, tantalum or titainum.

The following Examples and Comparative Examples illustrate the present invention in greater detail.

The chemical compositions of stainless steel test specimens used in these examples are shown in Table 1.

The rate of corrosion in these examples was determined as follows:

The corrosion product of a test specimen is removed by crude sodium bicarbonate or mechanically by means of a nylon brush. The specimen is then washed with water and methanol, and weighed to measure the corrosion loss (the amount of the specimen decreased as a result of corrosion). The rate of corrosion is calculated from the following equation.

$$\text{Rate of corrosion (mg/dm}^2\text{/day)} = \frac{\text{Corrosion loss (mg)}}{[\text{Surface area of the specimen (dm}^2)] \times [\text{Test period (day)}]}$$

Table 1

| | Specimens | C | Si | Mn | Cr | Ni | Mo | Cu |
|---|---|---|---|---|---|---|---|---|
| Invention | A | 0.04 | 0.71 | 1.52 | 19.47 | 4.25 | — | — |
| | B | 0.02 | 0.43 | 0.47 | 24.46 | 2.18 | — | — |
| | C | 0.02 | 0.69 | 0.48 | 24.90 | 4.46 | 1.51 | — |
| | D | 0.03 | 0.52 | 0.46 | 24.32 | 4.91 | 1.52 | 0.93 |
| | E | 0.03 | 0.45 | 0.49 | 25.10 | 6.82 | — | — |
| | F | 0.04 | 0.63 | 0.71 | 26.16 | 5.25 | 1.98 | 2.99 |
| Comparison | G | 0.07 | 0.58 | 0.38 | 16.91 | — | — | — |
| | H | 0.12 | 0.47 | 0.93 | 26.47 | — | — | — |
| | I | 0.07 | 0.78 | 1.64 | 18.02 | 9.69 | — | — |
| | J | 0.02 | 0.70 | 1.40 | 18.54 | 10.69 | — | — |
| | K | 0.07 | 0.59 | 1.22 | 17.70 | 10.96 | 2.15 | — |
| | L | 0.03 | 0.45 | 1.51 | 22.05 | 12.18 | 2.41 | — |
| | M | 0.07 | 0.89 | 1.94 | 18.20 | 22.18 | 2.63 | 1.88 |
| | N | 0.05 | 0.39 | 0.50 | 25.54 | 1.08 | — | — |
| | O | 0.11 | 0.61 | 0.83 | 24.82 | 2.27 | 1.43 | — |
| | P | 0.04 | 1.6 | 0.68 | 18.36 | 4.63 | 2.6 | — |

EXAMPLE 1

In a 1.2-liter silver-lined pressure reactor having a diameter of 40 mm and a height of 1,200 mm, each of the stainless steel test specimens shown in Table 2 (15 mm wide, 70 mm long, and 2 mm thick) was suspended by means of a Teflon cord. From the top of the reactor, a solution containing 1 g/liter of silicotungstic acid was fed at a rate of 3 Kg/hour per liter of the inner capacity of the reactor. From the bottom of the reactor, propylene was introduced at a rate of 0.2 Kg/hour and continuously hydrated at 300° C. and 200 Kg/cm².G. After a lapse of the periods shown in Table 2, the corrosion loss of the specimen was measured. The rate of corrosion was calculated, and is shown in Table 2.

After testing the specimens shown in Table 2 for 4992 hours, they were subjected to X-ray diffraction. It was ascertained therefore that the protective film consisted of $Cr_2WO_6$ and $NiWO_4$. The fluorescence X-ray analysis of the specimens showed that they also contained $FeWO_4$.

Table 2

| Specimens | Rate of corrosion (mg/dm²/day) 750 hours | 4992 hours |
|---|---|---|
| A | 9.2 | 3.2 |
| B | 6.3 | 2.4 |
| C | 4.8 | 1.5 |
| D | 5.1 | 1.4 |
| E | 7.6 | 2.7 |
| F | 4.2 | 1.3 |
| G | 19.5 | 6.1 |
| H | 8.2 | 3.1 |
| I | 29.9 | 9.6 |
| K | 54.2 | 15.3 |
| L | 6.7 | 2.7 |
| M | 96.1 | 29.7 |
| N | 7.9 | 2.9 |
| P | 14.6 | 4.8 |

The same test specimens as shown in Table 2 were tested for sensitivity to stress corrosion cracking. Each of the test specimens was heat-treated under the conditions shown in Table 3, and bent in a U-shape ($R = 3t$, in which R is the radius (mm) of the U-shaped bending, and $t$ is the thickness (mm) of the test specimen) to impart stress. The presence of cracks after the testing was ascertained visually and by an optical microscope. The results are shown in Table 3.

Table 3

| | Test Specimens | No. | Heat-treatment followed by air cooling | Test period (hours) | Results |
|---|---|---|---|---|---|
| Invention | A | 1 | Non-treated | 4992 | No cracking |
| | | 2 | 550° C. × 2 hrs. | 2720 | " |
| | | 3 | 650° C. × 2 hrs. | " | " |
| | | 4 | 750° C. × 2 hrs. | " | " |
| | | 5 | 800° C. × 2 hrs. | " | " |
| | B | 6 | Non-treated | 4992 | No cracking |
| | | 7 | 500° C. × 2 hrs. | 2720 | " |
| | | 8 | 800° C. × 2 hrs. | " | " |
| | | 9 | 900° C. × 2 hrs. | " | " |
| | | 10 | 950° C. × 2 hrs. | " | " |
| | C | 11 | Non-treated | 4992 | No cracking |
| | | 12 | 500° C. × 2 hrs. | " | " |
| | | 13 | 550° C. × 2 hrs. | " | " |
| | | 14 | 650° C. × 2 hrs. | " | " |
| | | 15 | 750° C. × 2 hrs. | " | " |
| | | 16 | 800° C. × 2 hrs. | " | " |
| | D | 17 | Non-treated | 4992 | No cracking |
| | | 18 | 500° C. × 2 hrs. | " | " |
| | | 19 | 650° C. × 2 hrs. | " | " |
| | | 20 | 750° C. × 2 hrs. | " | " |
| | | 21 | 800° C. × 2 hrs. | " | " |
| | E | 22 | Non-treated | 2720 | No cracking |
| | | 23 | 650° C. × 2 hrs. | " | " |
| | | 24 | 750° C. × 2 hrs. | " | " |
| | | 25 | 800° C. × 2 hrs. | " | " |
| | F | 26 | Non-treated | 2720 | No cracking |
| | | 27 | 650° C. × 2 hrs. | " | " |
| | | 28 | 750° C. × 2 hrs. | " | " |
| | | 29 | 800° C. × 2 hrs. | " | " |
| Comparison | H | 30 | Non-treated | 2720 | No cracking |
| | | 31 | 500° C. × 2 hrs. | " | " |
| | | 32 | 950° C. × 2 hrs. | " | Intergranular cracking |
| | I | 33 | Non-treated | 2720 | No cracking |
| | | 34 | 650° C. × 15 min | " | Intergranular cracking |
| | | 35 | 650° C. × 2 hrs. | " | " |
| | K | 36 | Non-treated | 2720 | No cracking |
| | | 37 | 650° C. × 2 hrs. | 707 | Intergranular cracking |
| | L | 38 | Non-treated | 2720 | No cracking |
| | | 39 | 650° C. × 2 hrs. | " | Intergranular cracking |
| | | 40 | 750° C. × 2 hrs. | " | " |
| | | 41 | 850° C. × 2 hrs. | " | " |
| | N | 42 | Non-treated | 2720 | No cracking |
| | | 43 | 650° C. × 2 hrs. | " | " |
| | | 44 | 850° C. × 2 hrs. | " | " |
| | | 45 | 950° C. × 2 hrs. | | Intergranular cracking |
| | O | 46 | Non-treated | 2720 | No cracking |
| | | 47 | 650° C. × 2 hrs. | " | " |
| | | 48 | 950° C. × 2 hrs. | " | Intergranular cracking |
| | P | 49 | Non-treated | 2720 | No cracking |
| | | 50 | 500° C. × 2 hrs. | " | " |

Table 3-continued

| Test Specimens | No. | Heat-treatment followed by air cooling | Test period (hours) | Results |
|---|---|---|---|---|
| | 51 | 750° C. × 2 hrs. | " | " |

Figure 2:
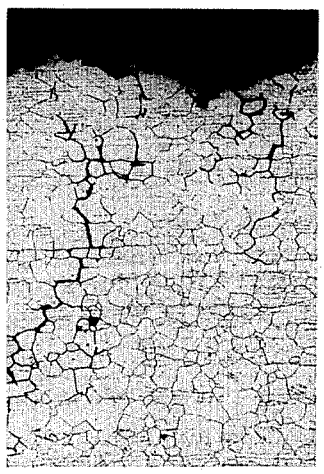
Figure 3:
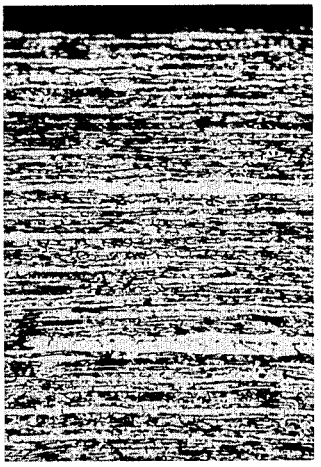
FIG. 3 is a microphotograph of a metal structure according to the present invention which has been treated with a solution containing heteropolyacid ions.

Microphotographs of typical examples of the structures of metals were taken, and shown in FIGS. 1, 2 and 3. FIG. 1 is a microphotograph of Specimen No. 32 in Table 3, Example 1, and FIG. 2 is a microphotograph of Specimen No. 35. These comparative test specimens exhibited intergranular corrosion cracking. In contrast, no crack was observed at all in FIG. 3 which is a microphotograph of Specimen No. 14 in Table 3.

EXAMPLE 2

The following experiment was conducted in order to determine the effect of each of the test specimens shown in Example 1 in the preparation of isopropanol from propylene.

An inner cylinder capable of being fitted substantially to a 1.5-liter silver-lined pressure reactor was made using each of the test specimens shown in Table 1, and inserted in the reactor. An aqueous solution containing 2 g/liter of silicotungstic acid and propylene were fed into the inner cylinder, and propylene was continuously hydrated at 300° C. and 200 Kg/cm².G. The resulting mixture consisting of isopropanol and the aqueous solution containing silicotungstic acid was withdrawn from the reactor. After separation of the isopropanol, the aqueous solution containing silicotungstic acid was recycled to the reactor. The above reaction was carried out for 1,024 hours. During a period of 24 hours after the initiation of the reaction, the reaction product was sampled six times, and the yield ratio of isopropanol and the percent decrease of the catalyst concentration were measured. Sampling was also performed six times during a period of 24 hours after a lapse of 500 hours from the initiation of the reaction, and after a lapse of 1000 hours from the initiation of the reaction. The results (average values) are shown in Table 4.

EXAMPLE 3

An aqueous solution of each of the various heteropolyacid ions shown in Table 5 was placed in an amount of 3 g/liter into a 800 ml. silver-lined autoclave, and a test specimen (30 mm wide, 50 mm long and 2 mm thick) of each of the stainless steels having the chemical compositions shown in Table 1 was immersed in the aqueous solution. It was allowed to stand at 270° C. and 60 Kg/cm².G for 100 hours. Then, it was withdrawn, and the rate of corrosion was determined. The results are shown in Table 5.

In all runs, the specific amount of the solution (the amount of the liquid per unit area of the test specimen) was the same.

Table 5

| Heteropolyacid | Test specimens | | Rate of corrosion (mg/dm²/day) |
|---|---|---|---|
| Silicotungstic acid | Invention | A | 19.2 |
| | | B | 10.5 |
| | | C | 9.7 |
| | | D | 10.1 |
| | | E | 15.4 |
| | | F | 8.9 |
| | Comparison | G | 58.9 |
| | | H | 14.6 |
| | | I | 73.2 |
| | | J | 103.5 |
| | | K | 163.7 |
| | | L | 15.8 |
| | | M | 248.5 |
| Borotungstic acid | Invention | A | 22.6 |
| | | C | 11.3 |
| | | D | 10.9 |
| | Comparison | G | 64.5 |
| | | I | 80.2 |
| | | K | 193.4 |
| Silicomolybdic acid | Invention | A | 14.8 |
| | | C | 7.6 |
| | | D | 7.5 |
| | Comparison | G | 54.6 |
| | | I | 69.0 |
| | | K | 123.7 |
| Sodium dihydrogen | | C | 7.2 |

Table 4

| Test specimens | | Initial catalyst concentration (g/l) | Reaction conditions: Temperature (° C.) | Reaction conditions: Pressure (Kg/cm²) | Initial 24 hours: Yield ratio of isopropanol | Initial 24 hours: Percent decrease of catalyst concentration | 24 hours after 500 hours: Yield ratio of isopropanol | 24 hours after 500 hours: Percent decrease of catalyst concentration | 24 hours after 1000 hours: Yield ratio of isopropanol | 24 hours after 1000 hours: Percent decrease of catalyst concentration |
|---|---|---|---|---|---|---|---|---|---|---|
| | As silver-lined | 2 | 300 | 200 | 100 | 0.6 | 98 | 0.7 | 98 | 0.7 |
| Invention | A | " | " | " | 57 | 12.4 | 83 | 3.4 | 97 | 1.0 |
| | B | " | " | " | 71 | 4.4 | 92 | 1.4 | 98 | 0.9 |
| | C | " | " | " | 67 | 5.5 | 94 | 1.3 | 98 | 0.8 |
| | D | " | " | " | 68 | 5.5 | 94 | 1.4 | 98 | 0.8 |
| | E | " | " | " | 71 | 4.4 | 94 | 1.6 | 98 | 0.9 |
| | F | " | " | " | 71 | 4.4 | 94 | 1.3 | 98 | 0.8 |
| | G | " | " | " | 49 | 24.8 | 83 | 3.8 | 89 | 2.1 |
| | H | " | " | " | 57 | 12.8 | 87 | 2.6 | 90 | 1.6 |
| | I | " | " | " | 44 | 33.2 | 62 | 8.2 | 67 | 4.8 |
| | K | " | " | " | 37 | 36.8 | 60 | 10.8 | 63 | 5.2 |
| Comparison | L | " | " | " | 60 | 11.1 | 92 | 1.5 | 97 | 1.0 |
| | M | " | " | " | 32 | 81.1 | 49 | 25.0 | 57 | 12.1 |
| | N | " | " | " | 60 | 11.1 | 90 | 1.6 | 95 | 1.2 |
| | P | " | " | " | 57 | 12.4 | 83 | 2.8 | 89 | 2.4 |

* The isopropanol yield ratio is a ratio based on the yield of isopropanol for the initial 24 hours using the silver-lined reactor alone which was taken as 100.

Table 5-continued

| Heteropolyacid | Test specimens | | Rate of corrosion (mg/dm²/day) |
|---|---|---|---|
| silicomolybdate | Invention | E | 14.0 |
| | | F | 7.1 |
| | | D | 9.8 |
| Potassium monohydrogen silicotungstate | Invention | E | 16.7 |
| | | F | 8.6 |

EXAMPLE 4

The relation between the rate of corrosion of each of the test specimens described in Table 6 and the test period was examined in the same way as in Example 1. The results are shown in Table 6.

Table 6

| Test specimens | | Test period (hours) | Rate of corrosion (mg/dm²/day) |
|---|---|---|---|
| Invention | C | 100 | 22.5 |
| | | 300 | 13.2 |
| | | 707 | 5.1 |
| | | 2050 | 2.4 |
| | | 2720 | 2.1 |
| | | 3230 | 1.6 |
| | | 4992 | 1.5 |
| | D | 100 | 23.6 |
| | | 300 | 12.4 |
| | | 2720 | 1.9 |
| | | 3230 | 1.5 |
| | | 4992 | 1.4 |
| Comparison | I | 100 | 73.2 |
| | | 678 | 32.1 |
| | | 2720 | 14.8 |
| | | 4992 | 9.6 |

The rate of corrosion of the test specimen C shown in Table 6 is plotted in FIG. 4. It can be seen from FIG. 4 that when the chromium/nickel stainless steel used in this invention is pre-treated with a heteropolyacid for 300 hours, preferably 500 hours, the corrosion rate of the stainless steel is reduced drastically.

EXAMPLE 5

720 ml. of a solution containing a silicotungstic acid ion was placed into a 800 ml. silver-lined autoclave, and each of the test specimens measuring 50 mm in width, 30 mm in length and 2 mm in thickness was immersed in it for 100 hours at a temperature of 270° C. and a pressure of 60 atmospheres. The concentration and pH of the silicotungstic acid solution before and after the test are shown in Table 7.

Table 7

| Test specimens | | Before testing | | After testing | |
|---|---|---|---|---|---|
| | | Concentration (g/l) | pH | Concentration (g/l) | pH |
| Comparison | Silver | 2.8 | 2.5 | 2.8 | 2.5 |
| | I | 2.8 | 2.5 | 1.3 | 2.9 |
| | K | 2.8 | 2.5 | 1.4 | 2.9 |
| | H | 2.8 | 2.5 | 2.3 | 2.7 |
| | N | 2.8 | 2.5 | 2.3 | 2.7 |
| | P | 2.8 | 2.5 | 1.3 | 2.8 |
| Invention | A | 2.8 | 2.5 | 2.2 | 2.7 |
| | C | 2.8 | 2.5 | 2.6 | 2.6 |
| | D | 2.8 | 2.5 | 2.7 | 2.5 |
| | F | 2.8 | 2.5 | 2.7 | 2.5 |

EXAMPLE 6

Example 3 was repeated except that silicomolybdic acid was used as the heteropolyacid, each of the test specimens measuring 30 mm in width, 30 mm in length and 2 mm in thickness as shown in Table 8 was used, and the test specimen was immersed for 300 hours in the silicomolybdic acid solution. The amount of hydrogen contained in the test specimen was measured before the immersion and after a lapse of 300 hours to determine whether it would undergo hydrogen embrittlement. The results are shown in Table 8. The measurement of the amount of hydrogen in the test specimen was performed using a hydrogen analyzer (a product of Oka Kogyo Kabushiki Kaisha).

Table 8

| Test specimens | | Results | |
|---|---|---|---|
| | | Amount of hydrogen before testing (ppm) | Amount of hydrogen after testing for 300 hours (ppm) |
| Invention | C | 21.8 | 22.0 |
| | D | 25.1 | 25.6 |
| Comparison | Tantalum | 24.1 | 285 |
| | Titanium | 48.0 | 136 |
| | Zirconium | 35.4 | 460 |

What we claim is:

1. In combination, a container and a solution containing heteropolyacid ions therein, at least that surface of the container which makes contact with the solution containing heteropolyacid ions being made of an alloy comprising 2 to 7% by weight of nickel, 19 to 27% by weight of chromium, not more than 0.05% by weight of carbon and the remainder being iron and minor elements.

2. The combination of claim 1 wherein the heteropolyacid ions are selected from the group consisting of silicotungstic acid, borotungstic acid, phosphotungstic acid, silicomolybdic acid and phosphomolybdic acid ions.

3. The combination of claim 1 wherein the solution containing heteropolyacid ions is maintained at a temperature of at least 100° C. and a pressure of at least 10 Kg/cm².

4. The combination of claim 1 wherein said container is a reactor used to prepare alcohols by the hydration reaction of olefins and said solution containing the heteropolyacid ions is present as a catalyst for said reaction.

5. The combination of reactor and catalyst solution containing heteropolyacid ions for the hydration reaction of olefins according to claim 4 wherein at least that surface of the reactor which makes contact with the catalyst solution containing the heteropolyacid has been contacted, prior to the hydration reaction, with a solution containing heteropolyacid ions for at least 300 hours.

6. The combination of claim 1 wherein the surface of said container in contact with said heteropolyacid ions has a protective coating which substantially prevents corrosion of said surfaces by said heteropolyacids ions, said protective coating also substantially preventing decomposition of said heteropolyacid ions, said coating consisting essentially of the product of the reaction between heteropolyacid ions with the components of said alloy, said reaction being maintained for a period of at least 300 hours.

7. The combination of claim 6 wherein the surface of said container is contacted with a solution containing heteropolyacid ions for a period of at least 500 hours.

8. An improved container for containing a solution containing heteropolyacid ions, said improvement comprised in that, at least the surfaces of said container in contact with said heteropolyacid ions are nickel-chromium stainless steel alloy having a protective coating which substantially prevents corrosion of said surfaces by said heteropolyacid ions, said protective coating also substantially preventing decomposition of said heteropolyacid ions, said coating consisting essentially of the product of the reaction between heteropolyacid ions with the components of said nickel-chromium stainless steel alloy, said reaction being maintained for a period of at least 300 hours, said alloy comprising 2 to 7% by weight of nickel, 19 to 27% by weight of chromium, not more than 0.05% by weight of carbon, and the remainder being iron and minor elements.

9. The improved container of claim 8 wherein said reaction is maintained for a period of at least 500 hours.

10. The improved container of claim 8 wherein said heteropolyacid ions are selected from the group consisting of silicotungstic acid, borotungstic acid, phosphotungstic acid, silicomolybdic acid and phosphomolybdic acid ions.

11. A method for containing a solution containing heteropolyacid ions which comprises containing said solution in a container, the surfaces of which being in contact with said solution, are formed from an alloy comprising 2 to 7% by weight of nickel, 19 to 27% of chromium, not more than 0.05% by weight of carbon and the remainder being iron and minor elements.

12. The method of claim 11 wherein said solution containing heteropolyacid ions is maintained at a temperature of at least 100° C. and a pressure of at least 10 $Kg/cm^2$.

13. A process for preparing a container for handling a solution containing heteropolyacid ions wherein at least the surfaces of said container which come into contact with said solution containing heteropolyacid ions is an alloy comprised of 2 to 7% by weight of nickel, 19 to 27% by weight of chromium, not more than 0.05% by weight of carbon and the remainder being iron and minor elements, said process comprising maintaining said surfaces in contact with a solution containing heteropolyacid ions for a period of at least 300 hours whereby the corrosion of said surfaces approaches a substantially constant rate and a protective coating which is the product of the reaction between said heteropolyacid ions and the components of said alloy is formed, said protective coating substantially preventing any additional corrosion of said surfaces and also substantially preventing decomposition of said heteropolyacid ions.

14. The process of claim 13 wherein the surfaces of said container are maintained in contact with the solution of heteropolyacid ions for a period of at least 500 hours.

* * * * *

UNITED STATES PATENT OFFICE

CERTIFICATE OF CORRECTION

Patent No. 3,994,392 Dated November 30, 1976

Inventor(s) Yoshihisa Kajiyama et al.

It is certified that error appears in the above-identified patent and that said Letters Patent are hereby corrected as shown below:

Item 73, line 2, before "Japan" insert -- Yamaguchi-ken --.

Signed and Sealed this

Twenty-second Day of March 1977

[SEAL]

*Attest:*

RUTH C. MASON
*Attesting Officer*

C. MARSHALL DANN
*Commissioner of Patents and Trademarks*